US006526720B2

(12) United States Patent
Maddy

(10) Patent No.: US 6,526,720 B2
(45) Date of Patent: Mar. 4, 2003

(54) MASONRY BLOCK

(75) Inventor: Robert J. Maddy, St. Albans, WV (US)

(73) Assignee: Peerless Block & Brick, Co., St. Albans, WV (US)

( * ) Notice: Subject to any disclaimer, the term of this patent is extended or adjusted under 35 U.S.C. 154(b) by 0 days.

(21) Appl. No.: 09/887,616

(22) Filed: Jun. 22, 2001

(65) Prior Publication Data

US 2002/0000073 A1 Jan. 3, 2002

Related U.S. Application Data

(60) Provisional application No. 60/214,070, filed on Jun. 26, 2000.

(51) Int. Cl.[7] ..... E04B 5/04

(52) U.S. Cl. ..... 52/596; 52/98; 52/605; 52/741.1; 53/591; 206/322

(58) Field of Search ..... 52/98, 536, 605, 52/741.1; 53/589, 591; 206/322

(56) References Cited

U.S. PATENT DOCUMENTS

| | | | | | |
|---|---|---|---|---|---|
| 1,071,782 | A | * | 9/1913 | Nickson | 52/213 |
| 1,945,681 | A | * | 2/1934 | Farrens | 52/605 X |
| 2,176,805 | A | * | 10/1939 | Scheibl | 52/605 |
| 2,844,091 | A | * | 7/1958 | Shafer et al. | 53/589 X |
| 3,003,296 | A | * | 10/1961 | Feldkamp et al. | 53/399 |
| 3,329,262 | A | * | 7/1967 | Martin et al. | 206/322 |
| 4,524,551 | A | * | 6/1985 | Scheiwiller | 52/98 |
| 5,598,679 | A | * | 2/1997 | Orton et al. | 52/609 |
| 5,687,531 | A | * | 11/1997 | Nelson et al. | 52/596.1 |
| 5,899,046 | A | * | 5/1999 | Hughes | 53/139.7 |

FOREIGN PATENT DOCUMENTS

| | | | | |
|---|---|---|---|---|
| CH | 107354 | * | 3/1925 | 52/605 |
| CH | 308222 | * | 9/1955 | 52/605 |
| DE | 4342221 A1 | * | 6/1995 | B65D/71/02 |
| FR | 501069 | * | 1/1920 | 52/605 |
| WO | WO 90/13716 | * | 11/1990 | E04C/1/39 |

* cited by examiner

*Primary Examiner*—Carl D. Friedman
*Assistant Examiner*—Brian E. Glessner
(74) *Attorney, Agent, or Firm*—Steptoe & Johnson PLLC

(57) ABSTRACT

A masonry block having indentations and rounded and recessed portions to facilitate the bundling and transport of a bundle of the masonry blocks using convention bundling straps. A bundle of masonry blocks is formed such that on the top row of the bundle the indentations of the masonry blocks are facing upward, and on the bottom row of the bundle the indentations of the masonry blocks are facing the ground. The masonry blocks are also positioned such that the external edges of the rows of the bundle comprise rounded and recessed portions of the masonry blocks.

16 Claims, 5 Drawing Sheets

MASONRY BLOCK

CROSS-REFERENCE TO RELATED APPLICATIONS

This application claims the benefit of U.S. application Ser. No. 60/214,070 filed Jun. 26, 2000.

BACKGROUND OF THE INVENTION

1. Field of the Invention

This invention relates to masonry blocks, and more particularly, to a masonry block having indentations and recessed edges to facilitate bundling and transport, and to allow the use of metal or plastic or other strapping materials with or without the use of separate edge protective materials.

2. Related Art

Masonry blocks are bundled together in bulk for storage and transport. Bundles generally include numerous rows and numerous columns, each having a plurality of masonry blocks. Typically, bundles are held together by one or more bundling straps, often made of metal or plastic, wrapped around the bundle, as well as by comer boards or other edge restraints, and additionally by stretch or shrink wrap, to hold the masonry blocks in the bundled configuration during transport.

Conventional masonry blocks are square or rectangular and have sharp edges as a result of adjacent faces of the masonry block combining to form right angles. As a result, several problems are encountered when wrapping bundles of conventional masonry blocks. First, if a metal strap is used, the strap must be bent around the comers of the bundle. Once the metal strap is bent, it is virtually impossible to tighten the strap around the bundle because the metal strap cannot slide, or flow, over the edges of the bundle. Second, if a plastic (or nylon or cloth) strap is used, upon tightening the strap around the bundle, the strap becomes frayed or cut, thereby compromising the integrity of the strap. Third, once a bundle is assembled, it is often pushed or dragged along the ground by a transient vehicle to move it from one location to another. However, as a bundle is being pushed or dragged, the straps that extend underneath the bundle often get hung up, abraded, or snagged on the ground, thereby making it difficult or impossible to move the bundle along the ground without damage to the strapping.

In an attempt to solve the problems associated with bundling masonry blocks and moving them along the ground, often times a block manufacturer uses corner edge protection to lay across the square corners of a bundle. While this technique may help prevent fraying or cutting of the strap, it does nothing to prevent snagging the strap on the ground. Also, this practice increases the materials, expense, and time needed to bundle masonry blocks.

Therefore, what the art needs is a new masonry block and an improved means to bundle masonry blocks that require no additional materials, that prevents snagging of the strap (s) on the ground, that permits tightening of the strap(s) without causing fraying or cutting, and that results in the use of horizontal straps eliminating the need for supplemental stretch or shrink wrapping.

SUMMARY OF INVENTION

The masonry block of the present invention solves the problems encountered with the use of straps in bundling conventional masonry blocks by providing a masonry block having at least one indentation on a face of the masonry block and at least one rounded recessed portion of an edge of the masonry block for the bundling strap to slide or flow over. The masonry blocks of the present invention can be positioned in a bundle such that an indentation of a face of a masonry block on the bottom row faces the ground, an indentation of a masonry block on the top row faces upward, and the rounded recessed portions of the edges of masonry blocks are on the exterior edges of the bundle to facilitate wrapping of the bundle with bundling straps.

An aspect of the invention is a masonry block, having a front face, a back face, a top face, a bottom face, a first side face, a second side face, a first long edge, a second long edge, a third long edge, a fourth long edge, a first short edge, a second short edge, a third short edge, a fourth short edge, a first intermediate edge, a second intermediate edge, a third intermediate edge, and a fourth intermediate edge, wherein the front face has at least one indentation for receiving a bundling strap, and wherein the first short edge has a rounded recessed portion for receiving a bundling strap, and the fourth short edge optionally has a rounded recessed portion also for receiving a bundling strap Another aspect of the invention is a bundle of masonry blocks, the bundle having external edges, including a bottom row of masonry blocks. Each masonry block has a front face, a back face, a top face, a bottom face, a first side face, a second side face, a first long edge, a second long edge, a third long edge, a fourth long edge, a first short edge, a second short edge, a third short edge, and a fourth short edge, wherein the front face has an indentation extending from the first long edge to the second long edge, wherein the first short edge has a rounded recessed portion and wherein the fourth short edge optionally has a rounded recessed portion. A horizontal bundling strap extends horizontally around the bundle, wherein each masonry block of a row is positioned such that the front face of the masonry block is facing the ground, and each vertical external edge of the bundle has a rounded recessed portion. The horizontal bundling strap is positioned such that it passes through the rounded recessed portion of the edges of a masonry block.

Another aspect of the invention is a bundle of masonry blocks, the bundle having external edges, including a column of masonry blocks. Each masonry block has a front face, a back face, a top face, a bottom face, a first side face, a second side face, a first long edge, a second long edge, a third long edge, a fourth long edge, a first short edge, a second short edge, a third short edge, and a fourth short edge, wherein the front face has an indentation extending from the first long edge to the second long edge, the first short edge has a rounded recessed portion, the fourth short edge optionally has a rounded recessed portion, and wherein the column has a bottom masonry block and a top masonry block. A vertical bundling strap extends around the column of masonry blocks and is positioned within the indentation of the bottom masonry block and the indentation of the top masonry block, wherein the bottom masonry block is positioned such that the front face of the bottom masonry block is facing the ground and the top masonry block is positioned such that the front face of the top masonry block is facing upwards. Also, the edges of the indentations have rounded recessed portions.

Another aspect of the invention is a method of bundling masonry blocks having a front face, a back face, a top face, a bottom face, a first side face, a second side face, a first long edge, a second long edge, a third long edge, a fourth long edge, a first short edge, a second short edge, a third short edge, and a fourth short edge, wherein the front face has an indentation extending from the first long edge to the second long edge, the first short edge has a recessed portion, and the fourth short edge has a recessed portion. The method includes the steps of: (a) assembling a bottom row of masonry blocks such that the front face of each masonry block is facing the ground; (b) assembling a top row of masonry blocks such that the front face of each masonry block is facing upwards; and (c) securing one or more bundling straps around the masonry blocks such that the one or more bundling straps rests in the indentation of the front face of the top and bottom row of masonry blocks as well as rests in the recessed portions of edges of certain masonry blocks.

An advantage of the invention is that when a plurality of masonry blocks of the present invention are bundled for storage or transport, the bundle can easily be pushed or dragged along the ground without the bundling straps getting snagged, abraded, or caught on the ground.

Another advantage of the invention is that the bundling straps can be easily tightened because they pass over rounded recessed portions of one or more edges.

Another advantage of the invention is that the blocks can be stacked together into a wall unit without having any rounded recessed portions visible on the one side of the wall because the back face of the masonry blocks of the present invention has straight edges.

Another advantage of the invention is that it allows for the elimination of supplemental packaging material, e.g., stretch or shrink wrapping, thereby reducing packaging cost and waste.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1A:
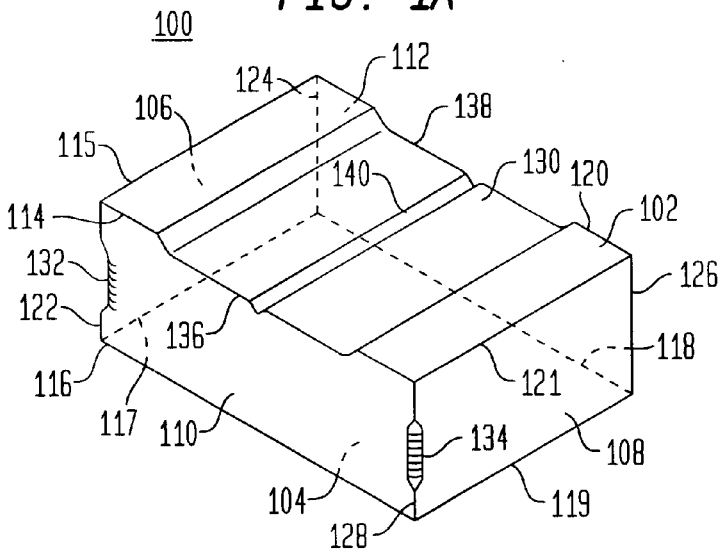
FIG. 1A is a perspective view of a masonry block of the present invention.

FIG. 1A is a perspective diagram showing a masonry block 100 of the present invention, wherein FIGS. 1B–3 are planar views of various faces of the masonry block 100. The masonry block 100 has six faces: a front face 102, a back face 104, a first side face 106, a second side face 108, a top face 110, and a bottom face 112 as defined by a first long edge 114, a second long edge 116, a third long edge 118, a fourth long edge 120, a first short edge 122, a second short edge 124, a third short edge 126, a fourth short edge 128, a first intermediate edge 115, a second intermediate edge 117, a third intermediate edge 119, and a fourth intermediate edge 121.

In the preferred embodiment as shown in FIG. 1A, the front face 102 has an indentation 130 extending from the first long edge 114 to the fourth long edge 120 wherein the indentation 130 is 25 inset about ⅜ of an inch from the surface of the front face 102. In addition, the first long edge 114 has a rounded recessed portion 136 and the fourth long edge 120 optionally has a rounded recessed portion 138 that define the top and bottom boundaries respectively, of the indentation 130 of the front face 102. Alternatively, the indentation 130 can extend from the first intermediate edge 115 to the fourth intermediate edge 121. Also, alternatively, the first intermediate edge 115 and the fourth intermediate edge 121 can have rounded recessed portions corresponding to the rounded recessed portions 136 and 138 of the first and fourth long edges (114, 120 respectively).

Also in the preferred embodiment, each short edge 122, 128 of the top face 110 of the masonry block 100 has a rounded recessed portion 132, 134. Specifically, the first short edge 122 has a rounded recessed portion 132 and the fourth short edge 128 optionally has a rounded recessed portion 134. Preferably, each rounded recessed portion 132, 134 is a fixed length and is centrally located along the edge.

In addition, the masonry block 100 of the present invention optionally includes one or more darts along one or more faces to facilitate the splitting of the masonry block 100 into predefined smaller blocks. For example, in the preferred embodiment, the front face 102 of the masonry block 100 has a central dart 140 positioned within the indentation 130 and extending from the first long edge 114 to the second long edge 116. The central dart 140 is made according to conventional practices such that upon the application of pressure, e.g., from a chisel, the masonry block 100 will split along the central dart 140. In addition, the front face 102 can include a quarter line dart located one fourth of the distance between the first short edge 122 and the fourth short edge 128 and extending from the first long edge 114 to the second long edge 116.

Figure 1B:
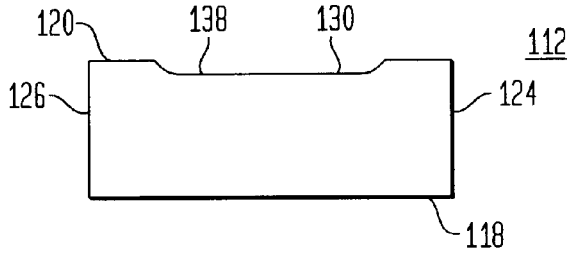
FIG. 1B is a planar view of the bottom face of the masonry block.

FIG. 1B is a planar view of an embodiment of the bottom face 112 of the masonry block 100 of the present invention. The bottom face 112 is defined by a third long edge 118, a fourth long edge 120, a second short edge 124, and a third short edge 126. The fourth long edge 120 has a rounded recessed portion 138 that defines the bottom boundary of the indentation 130.

Figure 1C:
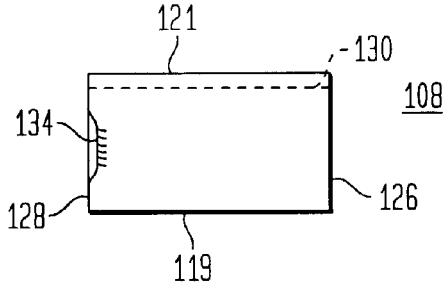
FIG. 1C is a planar view of a side face of the masonry block.

FIG. 1C is a planar view of an embodiment of the second side face 108 of the masonry block 100 of the present invention. The second side face 108 is defined by a third short edge 126, a fourth short edge 128, a third intermediate edge 119, and a fourth intermediate edge 121. The fourth short edge 128 has a rounded recessed portion 134. The indentation 130 of the front face 102 is depicted as being below the horizontal plane of the fourth intermediate edge 121.

Figure 1D:
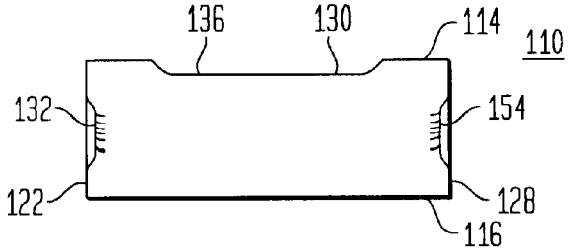
FIG. 1D is a planar view of the top face of the masonry block.

FIG. 1D is a planar view of an embodiment of the top face 110 of the masonry block 100 of the present invention. The top face 110 is defined by a first long edge 114, a second long edge 116, a first short edge 122, and a fourth short edge 128. The first long edge 114 has a rounded recessed portion 136 that defines the top boundary of the indentation 130. The first short edge 122 has a rounded recessed portion 132 and the second short edge 128 has a rounded recessed portion 134.

Figure 2:
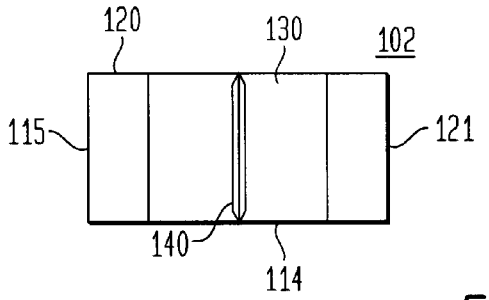
FIG. 2 is a planar view of the front face of the masonry block.

FIG. 2 is a planar top view of an embodiment of the front face 102 of the masonry block 100 of the present invention. The front face 102 is defined by a first long edge 114, a fourth long edge 120, a first intermediate edge 115, and a fourth intermediate edge 121. The front face 102 has an indentation 130 that extends from the first long edge 114 to the fourth long edge 120. The front face 102 also optionally, but preferably includes a dart 140 through the center of the indentation 130. The dart 140 facilitates the splitting of the masonry block 100 into predefined smaller blocks.

Figure 3:
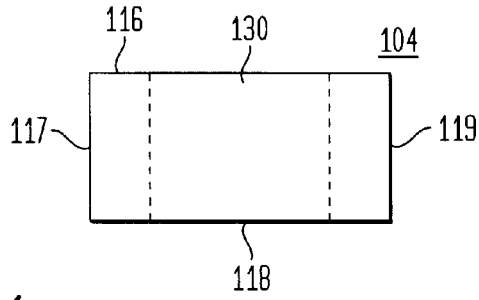
FIG. 3 is a planar view of the back face of the masonry block.

FIG. 3 is a planar bottom view of an embodiment of the back face 104 of the masonry block 100 of the present invention. The back face 104 is defined by a second long edge 116, a third long edge 118, a second intermediate edge 117, and a third intermediate edge 119. The edges of the back face (116, 118, 117, 119) do not have any indentations or rounded recessed portions, therefore a smooth block wall can be made by laying the masonry blocks 100 of the present invention such that the back face 104 of the masonry blocks 100 forms the outside of the wall, i.e. the portion of the wall that is visible to onlookers. See FIG. 5. A smooth block wall facilitates coating where required, such as when a surface bonding mortar, e.g, a clay sealer or fiber reinforced mortar, is applied to the block wall.

Figure 4:
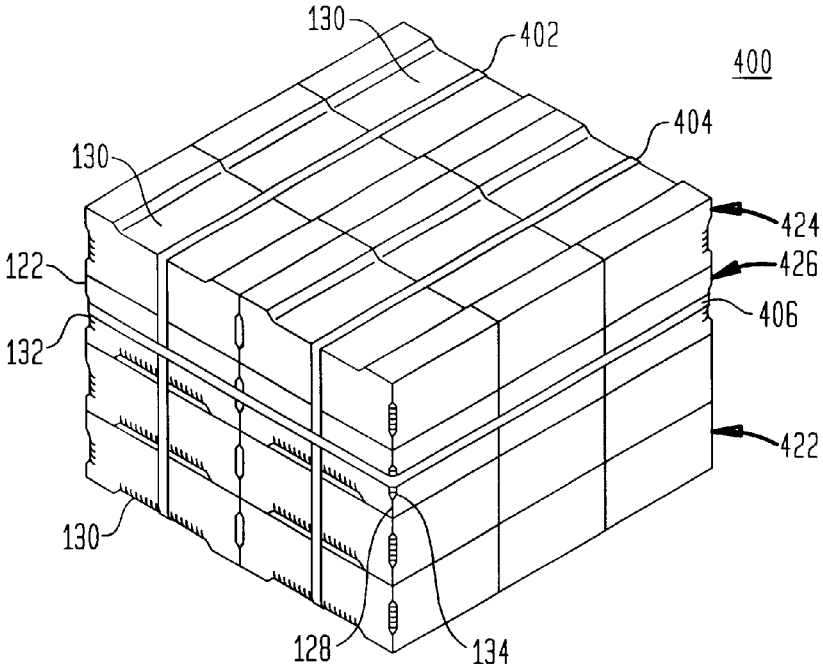
FIG. 4 is a perspective view of a bundle of masonry blocks.

FIG. 4 is a perspective diagram of a bundle 400 of a plurality of masonry blocks 100. In the preferred embodiment, when assembling a bundle 400, the bottom row 422 of the bundle 400 is comprised of masonry blocks 100 wherein the front face 102 of each masonry block 100 of the bottom row 422 is facing the ground. In contrast, each masonry block 100 of the top row 424 of the bundle 400 is positioned such that the front face 102 of each masonry block 100 is facing upwards. Therefore, one or more vertical bundling straps 402, 404 extending around the bundle 400 vertically are positioned within the indentations 130 of the masonry blocks 100 of the bottom row 422 and the top row 424.

This configuration of the bottom row 422 and top row 424 provide several advantages. First, if the bundle 400 is pushed or dragged along the ground, the vertical bundling straps 402, 404 will not snag or otherwise get caught on the ground. Second, the rounded recessed portions of the edges of the indentations 130 of the masonry blocks 100 of the bottom row 422 and top row 424 allow the vertical bundling straps 402, 404 to be tightened.

Also when assembling the bundle 400, the masonry blocks 100 of any row, e.g., middle row 426, wherein a horizontal bundling strap 406 is to be used, are positioned such that the first short side 122 and the fourth short side 128 (the two short sides having rounded recessed portions 132, 134 respectively), are on the outside or external edges of the bundle 400. Therefore, when a horizontal bundling strap 406 is extended around a row, e.g., the middle row 426, the horizontal bundling strap 406 falls within the rounded recessed portions, e.g., rounded recessed portions 132, 134, of the vertical external edges of the bundle 400. This configuration is also advantageous in that the horizontal bundling strap 406 can be easily located, tightened and retained.

Figure 5:
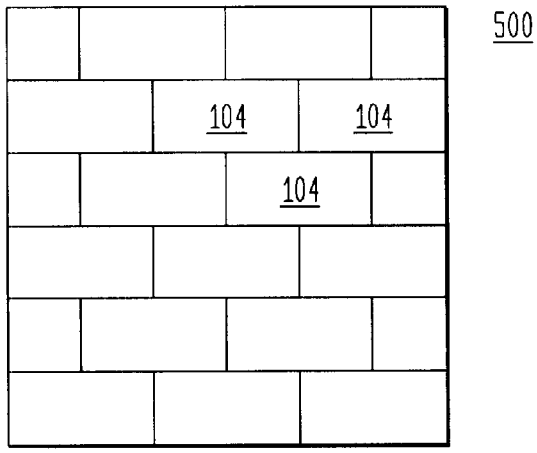
FIG. 5 is a planar view of a stack of masonry blocks.

FIG. 5 is a planar view of a dry stacking of masonry blocks 100 of the present invention into a block wall 500 wherein the back face 104 of each masonry block 100 that is dry stacked into the block wall 500 is facing the same direction. The resulting block wall 500 has no rounded recessed portions, or indentations, visible, thereby facilitating the construction of a smooth wall surface. That is, there are no indentations, or rounded recessed portions that would need to be filled in to create a smooth surface.

In the preferred embodiment, the masonry block 100 has dimensions of about 16 inches by 8 inches by 6 inches, and is made of a cementitious composition. All dimensions and compositions are used in the preferred embodiment and are for convenience purpose only. It would be readily apparent to one of ordinary skill in the relevant art(s) to design and manufacture a masonry block of the present invention using different dimensions and comparable materials, e.g, a material selected from the group of cement, a cementitious composition, a composite composition, foam crete, wood, metal, and cardboard. Therefore, these alternative embodiments are intended to be within the scope of the present invention.

Figure 6A:
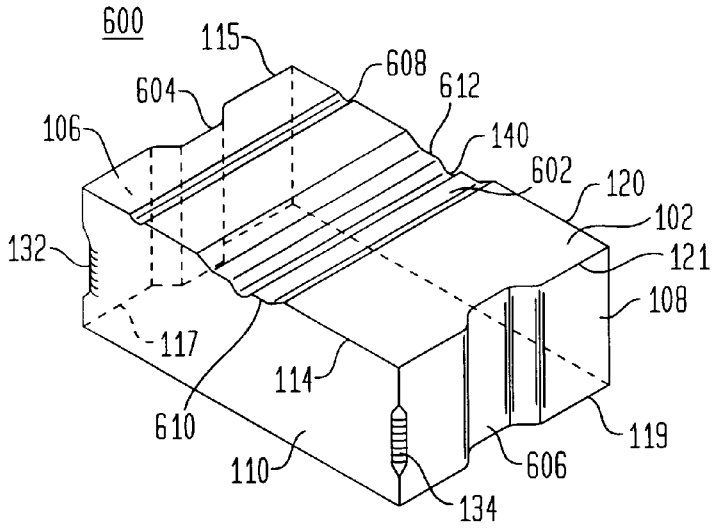
FIG. 6A is a perspective view of an alternative masonry block of the present invention.
Figure 6B:
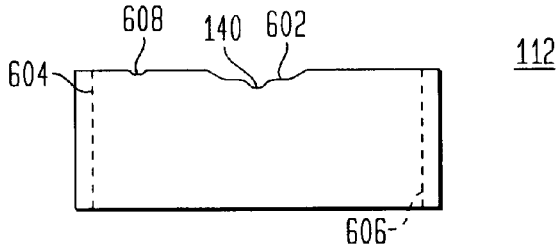
FIG. 6B is a planar view of the bottom face of the alternative masonry block.
Figure 6C:
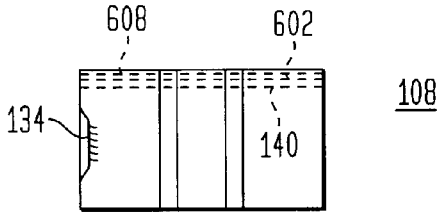
FIG. 6C is a planar view of a side face of the alternative masonry block.
Figure 6D:
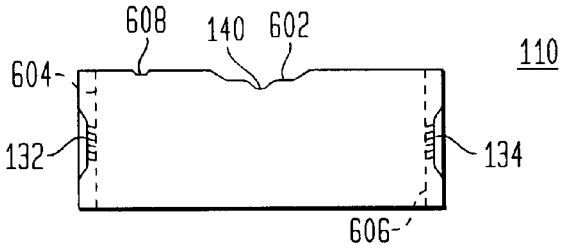
FIG. 6D is a planar view of the top face of the alternative masonry block.

FIG. 6A is a perspective diagram showing an alternative embodiment of the masonry block 600 of the present invention, wherein FIGS. 6B–6D are planar views of various faces of the alternative masonry block 600. As with the masonry block 100 described above, the alternative masonry block 600 has six faces. In this embodiment, the front face 102 has an indentation 602 extending from the first long side 114 to the fourth long side 120 wherein the indentation 602 is no more than about ⅜ of an inch deep and is about 4 inches wide. In addition, the first long side 114 has a rounded recessed portion 610 and the fourth long side 120 has a rounded recessed portion 612 that define the top and bottom boundaries of the indentation 602 of the front face 102.

Also in this embodiment, the first side face 106 has a first indentation 604 and the second side face 108 has a second indentation 606. As with indentation 130 and indentation 602 described above, both the first indentation 604 and the second indentation 606 are recessed channels, about ⅜ inches deep and about 4 inches wide, extending the width of the first side face 106 and second side face 108 respectively, wherein the edges are preferably rounded. Alternatively, the first and second indentations 604, 606 can extend the length of the first side face 106 and second side face 108 respectively. Also, optionally, the first side face 106 and second side face 108 can each have a plurality of indentations. The two side indentations 604, 606 are used when creating a bundle 400 of alternative masonry blocks 600 wherein a bundling strap is positioned within the side indentations 604, 606.

In addition, as seen in FIGS. 6A–6D, a plurality of darts, such as for example, center dart 140 and side dart 608 can be incorporated into the masonry block 600 to facilitate the splitting of the masonry block 600. The number and location of darts 140, 608 are for convenience purpose only. It would be readily apparent for one of ordinary skill in the relevant art to use any number of darts positioned differently on a masonry block of the present invention, and therefore these alternative embodiments are intended to be within the scope of the present invention.

Figure 7A:
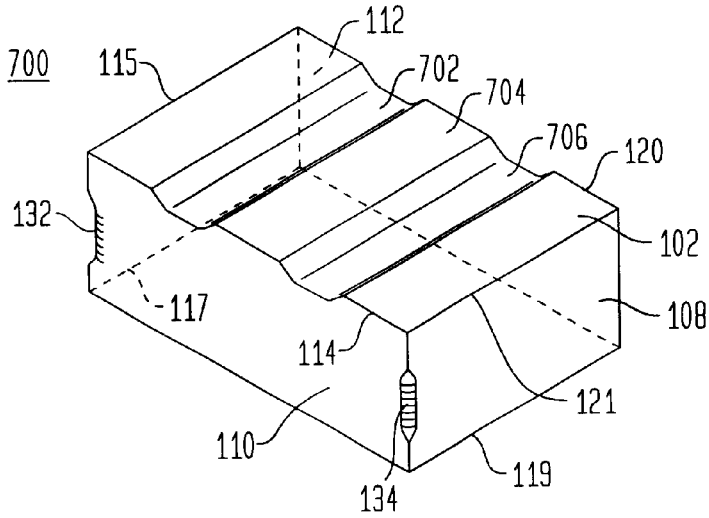
FIG. 7A is a perspective view of a second alternative masonry block of the present invention.
Figure 7B:
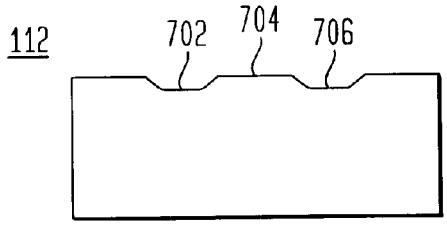
FIG. 7B is a planar view of the bottom face of the second alternative masonry block.
Figure 7C:
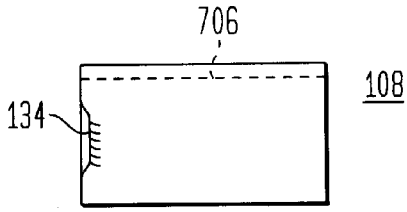
FIG. 7C is a planar view of a side face of the second alternative masonry block.
Figure 7D:
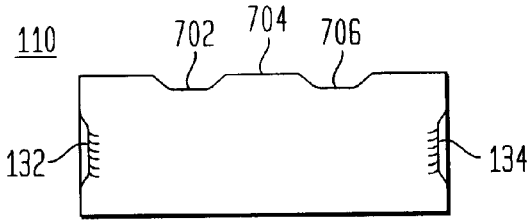
FIG. 7D is a planar view of the top face of the second alternative masonry block.
Figure 8A:
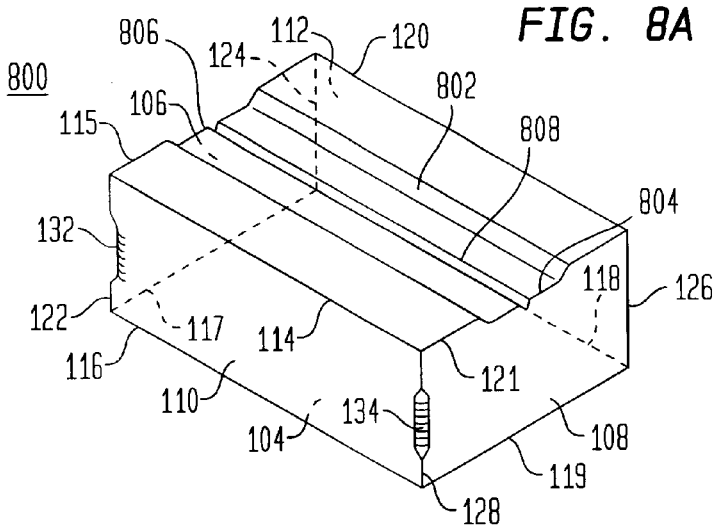
FIG. 8A is a perspective view of a third alternative masonry block of the present invention.
Figure 8B:
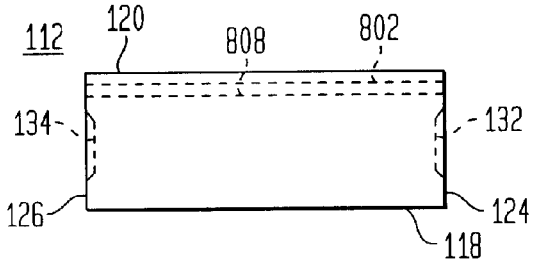
FIG. 8B is a planar view of the bottom face of the third alternative masonry block.
Figure 8C:
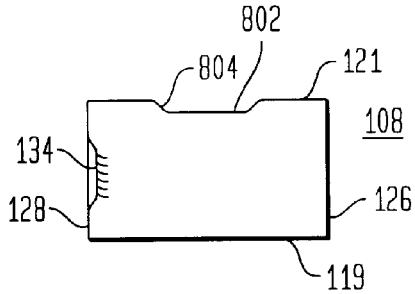
FIG. 8C is a planar view of a side face of the third alternative masonry block.
Figure 8D:
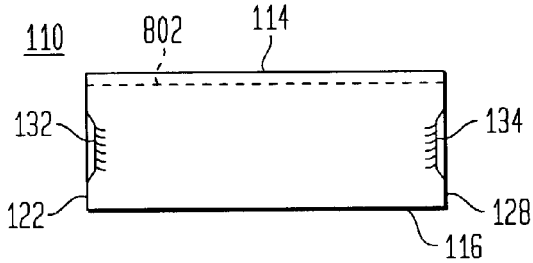
FIG. 8D is a planar view of the top face of the third alternative masonry block.

FIG. 7A is a perspective diagram showing a second alternative embodiment of the masonry block 700 of the present invention, wherein FIGS. 7B–7D are planar views of various faces of the second alternative masonry block 700. As with the masonry block 100 and alternative masonry block 600 described above, the second alternative masonry block 700 has six faces. In this alternative embodiment, the front face 102 has a plurality of indentations 702, 706 extending from the first long edge 114 to the fourth long edge 120 wherein the plurality of indentations 702, 706 are no more than about ⅜ of an inch deep. In addition, the edges of each indentation 702, 706 are rounded. Alternatively, the plurality of indentations 702, 706 can extend from the first intermediate edge 115 to the fourth intermediate edge 121. The second alternative masonry block 700 is shown in FIG. 7A as having a first indentation 702 and a second indentation 706, with a center raised portion 704 therebetween, for convenience purpose only. It would be readily apparent to one of ordinary skill in the relevant art to have a different number of indentations on a face of the masonry block 700 of the present invention. In operation, when creating a bundle 400 of masonry blocks 700, vertical bundling straps 402, 404 can be positioned in each of the indentations 702, 706, thereby making the bundle 400 more stable and secure.

The present invention is described above in terms of the number and placement of indentations and rounded recessed portions of edges for convenience purpose only. It would be readily apparent to one of ordinary skill in the relevant art to design, manufacture, and use a masonry block of the present invention having a different number of indentations and rounded recessed portions. These alternative embodiments are intended to be within the scope of the invention.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. A masonry block, comprising:

a front face, a back face, a top face, a bottom face, a first side face, a second side face, a first long edge, a second long edge, a third long edge, a fourth long edge, a first short edge, a second short edge, a third short edge, a fourth short edge, a first intermediate edge, a second intermediate edge, a third intermediate edge, and a fourth intermediate edge;

wherein said front face has an indentation for receiving a bundling strap; and wherein said first short edge has a recessed portion with a rounded edge for receiving a bundling strap.

2. The masonry block according to claim 1, wherein said fourth short edge has a rounded recessed portion for receiving a bundling strap.

3. The masonry block according to claim 1, wherein said indentation extends from said first long edge to said fourth long edge.

4. The masonry block according to claim 3, wherein said first long edge has a rounded recessed portion.

5. The masonry block according to claim 1, wherein said indentation extends from said first intermediate edge to said fourth intermediate edge.

6. The masonry block according to claim 5, wherein said first intermediate edge has a rounded recessed portion.

7. The masonry block according to claim 1, wherein said masonry block is made of a material selected from the group consisting of cement, a cementitious composition, a composite composition, foam crete, wood, metal, and cardboard.

8. The masonry block according to claim 1, wherein said first side face has an indentation extending from said first short edge to said second short edge.

9. The masonry block according to claim 8, wherein said second side face has an indentation extending from said third short edge to said fourth short edge.

10. The masonry block according to claim 1, wherein said first side face has an indentation extending from said first intermediate edge to said second intermediate edge.

11. The masonry block according to claim 10, wherein said second side face has an indentation extending from said third intermediate edge to said fourth intermediate edge.

12. The masonry block according to claim 1, further comprising one or more darts.

13. A bundle of masonry blocks, the bundle having vertical external edges, comprising:

a bottom row of masonry blocks, each masonry block comprising a front face, a back face, a top face, a bottom face, a first side face, a second side face, a first long edge, a second long edge, a third long edge, a fourth long edge, a first short edge, a second short edge, a third short edge, and a fourth short edge, wherein the front face has an indentation extending from the first long edge to the fourth long edge, the first long edge has a rounded recessed portion, and the first short edge has a rounded recessed portion; and one or more horizontal bundling straps extending horizontally around the bundle such that each said horizontal bundling strap is positioned in said rounded recessed portion of said first short edge;

wherein each said masonry block of said bottom row is positioned such that said front face of said masonry block is facing down; and wherein each said masonry block is positioned such that each vertical external edge of the bundle is said first short edge of one said masonry block having a rounded recessed portion.

14. The bundle of masonry blocks according to claim 13, further comprising:

a top row of masonry blocks, each masonry block comprising a front face, a back face, a top face, a bottom face, a first long edge, a second long edge, a third long edge, a fourth long edge, a first short edge, a second short edge, a third short edge, and a fourth short edge, wherein the front face has an indentation extending from the first long edge to the fourth long edge, the first long edge has a rounded recessed portion, the first short edge has a recessed portion;

a horizontal bundling strap extending horizontally around the bundle and passing through said rounded recessed portion of said first short side of one said masonry block; and a vertical bundling strap extending vertically around the bundle and passing through said indentation of one said masonry block;

wherein each said masonry block of said bottom row is positioned such that said front face of said masonry block is facing down;

wherein each said masonry block of said top row is positioned such that said front face of said masonry block is facing upwards; and wherein each said masonry block is positioned such that each vertical external edge of the bundle is said first short edge of one said masonry block having a rounded recessed portion.

15. A bundle of masonry blocks, the bundle having horizontal external edges, comprising:

a column of masonry blocks, each masonry block comprising a front face, a back face, a top face, a bottom face, a first long edge, a second long edge, a third long edge, a fourth long edge, a first short edge, a second short edge, a third short edge, a fourth short edge, a first intermediate edge, a second intermediate edge, a third intermediate edge, and a fourth intermediate edge, wherein the front face has an indentation extending from the first long edge to the fourth long edge, the first long edge has a rounded recessed portion, and the first short edge has a rounded recessed portion, and said column has a bottom masonry block and a top masonry block; and a vertical bundling strap extending around said column of masonry blocks and positioned within said indentation of said bottom masonry block and said indentation of said top masonry block;

wherein said bottom masonry block is positioned such that said front face of said bottom masonry block is facing down; and wherein said top masonry block is positioned such that said front face of said top masonry block is facing upwards.

16. A method of bundling masonry blocks, each said masonry block having:

a front face, a back face, a top face, a bottom face, a first side face, a second side face, a first long edge, a second long edge, a third long edge, a fourth long edge, a first short edge, a second short edge, a third short edge, a fourth short edge, a first intermediate edge, a second intermediate edge, a third intermediate edge, and a fourth intermediate edge;

wherein said front face has an indentation extending from said first long edge to said fourth long edge;

wherein said first short edge has a rounded recessed portion; the method comprising the steps of:

a. assembling a bottom row of said masonry blocks such that said front face of each said masonry block of said bottom row is facing down;

b. assembling a top row of said masonry blocks such that said front face of each said masonry block of said top row is facing upwards;

c. securing one or more horizontal bundling straps around said masonry blocks such that said one or more horizontal bundling straps are positioned in said rounded recessed portion of said first short edge of one or more said masonry blocks; and d. securing one or more vertical bundling straps around said masonry blocks such that said one or more vertical bundling straps are positioned in said indentation of said front face of one or more said masonry blocks.

* * * * *